US005201078A

United States Patent [19]

Melton

[11] Patent Number: 5,201,078

[45] Date of Patent: Apr. 13, 1993

[54] SHOULDER PAD AND BRASSIERE STRAP PAD APPARATUS

[76] Inventor: Ardella R. Melton, P.O. Box 6955, Phoenix, Ariz. 85005-6955

[21] Appl. No.: 712,448

[22] Filed: Jun. 10, 1991

[51] Int. Cl.[5] ..... A41D 27/26

[52] U.S. Cl. ..... 2/268; 2/267; 450/86

[58] Field of Search ..... 2/2, 24, 267, 268; 450/86

[56] References Cited

U.S. PATENT DOCUMENTS

| | | | |
|---|---|---|---|
| 1,631,694 | 6/1927 | Rick . | |
| 2,274,261 | 2/1942 | Vogel | 2/268 |
| 2,505,272 | 4/1950 | Blalock et al. . | |
| 2,587,101 | 2/1952 | Blalock et al. . | |
| 2,589,755 | 3/1952 | Ward et al. . | |
| 2,615,172 | 10/1952 | Donegan . | |
| 2,637,849 | 5/1953 | Nelson . | |
| 2,643,380 | 6/1953 | Blair . | |
| 2,654,887 | 10/1953 | Hookstratten | 2/2 |
| 2,671,223 | 3/1954 | Axsom | 2/268 |
| 2,763,004 | 9/1956 | Sanders . | |
| 2,765,469 | 10/1956 | King | 2/2 |
| 2,823,384 | 2/1958 | Eilertsen . | |
| 2,874,468 | 2/1959 | De Woskin . | |
| 3,050,734 | 8/1962 | Dopyera . | |
| 3,154,787 | 11/1964 | Newman | 2/2 |
| 3,229,694 | 1/1966 | Koropp . | |
| 4,472,838 | 9/1984 | Pompa . | |
| 4,575,874 | 3/1986 | Johnson . | |
| 4,612,935 | 9/1986 | Greifer . | |
| 4,638,513 | 1/1987 | Woods . | |
| 4,764,988 | 8/1988 | Reaver . | |
| 4,795,399 | 1/1989 | Davis . | |
| 4,795,400 | 1/1989 | Greenberg . | |
| 4,945,571 | 8/1990 | Calvert | 2/2 |
| 4,945,576 | 8/1990 | Melton . | |

FOREIGN PATENT DOCUMENTS

| | | | |
|---|---|---|---|
| 1123552 | 5/1982 | Canada | 2/24 |
| 0134727 | 3/1985 | European Pat. Off. | 2/2 |
| 8602646 | 10/1986 | Netherlands . | |

*Primary Examiner*—Werner H. Schroeder
*Assistant Examiner*—Jeanette E. Chapman
*Attorney, Agent, or Firm*—H. Gordon Shields

[57] ABSTRACT

Shoulder pad and bra strap apparatus includes two foldable portions for locking the bra strap in place over a cushion element. In one embodiment, there is a primary cushion only for the bra strap, with a very thin secondary pad for a shoulder pad. A second embodiment, a relatively thick shoulder pad is provided. The shoulder pad may be tapered, if desired.

19 Claims, 1 Drawing Sheet

SHOULDER PAD AND BRASSIERE STRAP PAD APPARATUS

BACKGROUND OF THE INVENTION

1. Field of the Invention;

This invention relates to padding apparatus and, more particularly, to a combination of shoulder pad and brassiere strap cushion.

2. Description of the Prior Art:

U.S. Pat. No. 1,631,694 (Rick) discloses a shoulder pad fitting beneath and secured to, a strap.

U.S. Pat. No. 2,505,272 (Blalock et al) discloses a pad for a brassiere (bra) strap. The pad extends generally along the same direction as the brassiere strap and includes two fasteners which cooperate with fastening elements on the brassiere strap to hold the pad in place beneath the strap and on the user's shoulder.

U.S. Pat. No. 2,587,101 (Blalock et al) discloses a pad that fits beneath a brassiere strap. The pad extends generally parallel to the bra strap and it includes a pair of flaps which open to receive a strap. The flaps then close to hold the strap to the pad.

U.S. Pat. No. 2,589,755 (Ward et al) discloses another type of shoulder pad and strap holder in which the pad includes outer edges which curl over on top of the strap. The strap accordingly is held in place beneath the rolled over outer edges of the pad.

U.S. Pat. No. 2,615,172 (Donegan) discloses another type of shoulder pad structure for a bra strap. The pad structure is an integral part of the strap.

U.S. Pat. No. 2,637,849 (Nelson) discloses a shoulder pad structure that fits beneath a bra strap. The pad is generally parallel to the strap. The pad includes prongs which pivot upwardly so that the strap may be placed on the pad, and then the prongs pivot downwardly to secure the strap to the pad.

U.S. Pat. No. 2,643,380 (Blair) discloses still another shoulder strap pad and holder. The pad is curved or configured to provide different thicknesses of the pad over the shoulder of the user. The pad structure includes what is referred to as "top walls" which pivot upwardly to receive the strap and then pivot downwardly to hold the strap in position on the pad.

U.S. Pat. No. 2,654,887 (Hookstratten) discloses pad apparatus disposed beneath a shoulder strap. Different configurations of the pad are shown. All of the configurations are generally parallel to the strap and are specifically for the purpose of providing pad protection for the strap.

U.S. Pat. No. 2,763,004 (Sanders) discloses another type of protective pad for a bra strap. The pad apparatus includes clips which bend over the strap to hold the pad in place.

U.S. Pat. No. 2,823,384 (Eilertsen) discloses a shoulder strap clasp which extends transversely with respect to a pair of straps. The clasp includes a flat portion which folds over the straps and extends beneath slots on opposite sides of the strap to hold the straps in place.

U.S. Pat. No. 2,874,468 (De Woskin) discloses an orthodontic device which includes a pad extending beneath an orthodontic traction band. The pad is disposed at the back of the neck of the user.

U.S. Pat. No. 3,050,734 (Dopyers) discloses shoulder strap pads that include fasteners for securing the strap to the pad. The pad is disposed generally parallel to the strap. Two different embodiments are illustrated.

U.S. Pat. No. 3,154,787 (Newman) discloses shoulder pad strap apparatus that receives a shoulder strap. The pad is disposed generally parallel to the shoulder strap.

U.S. Pat. No. 3,229,694 (Koropp) discloses another type of protective pad for a bra strap. The pad extends longitudinally, or aligned with the bra strap. The pad includes two portions which bend over to clasp a strap. The strap is inserted between the clasp elements on the pads, and the clasps hold the strap to the pad.

U.S. Pat. No. 4,472,838 (Pompa) discloses a shoulder strap pad which uses lambskin or sheepskin, with the fleece or wool disposed on the users bare shoulder. Cloth layers are secured to the outer hide portion of the lambskin or sheepskin for purposes of providing an external covering and for receiving the strap to be cushioned.

U.S. Pat. No. 4,575,874 (Johnson) discloses a shoulder strap pad which includes two portions, which are generally mirror images of each other. One portion becomes the bottom or cushion portion, and the second portion becomes the top portion which secures the strap to the apparatus.

U.S. Pat. No. 4,612,935 (Greifer) discloses cushion accessories for brassieres. The cushion accessories include cushions for the shoulder straps of the bra and side and back cushions for pressure diffusing straps to spread the pressure applied to the users shoulder straps.

U.S. Pat. No. 4,638,513 (Woods) discloses a bra strap which is referred to as laterally stabilized. The strap includes a padding or cushion portion and other features. The apparatus is an integral part of the garment to which it is secured or of which it is a part.

U.S. Pat. No. 4,764,988 (Reaver) discloses a pad structure for a bra strap. The novelty of this apparatus appears to be in the fastening elements involved.

U.S. Pat. No. 4,795,399 (Davis) discloses another type of shoulder pad for a bra strap. Again, as with most of the patents discussed above, the pad is generally parallel to the bra strap and serves only as a cushion for the bra strap.

U.S. Pat. No. 4,795,400 (Greenberg) discloses another type of bra strap which includes a cushion. The bra strap apparatus is integral with the garment.

All the above discussed patents include some type of padding for straps. Most of the patents refer to cushion or pad means for bra straps or other types of garment straps, and some are integral with the garment to which they are secured and others are removable so they may be used with different types of garments that do not have integral pads. However, none of the patents include pads which perform a dual function of providing a cushion for a bra strap and a shoulder pad.

U.S. Pat. No. 4,945,576 (Melton) discloses a combination shoulder pad and bra strap pad. The patentee of the '576 patent is the inventor of the present apparatus.

Nederland Patent 8,602,646 (Bara) discloses a releasable shoulder pad with elements to secure the shoulder pad to a bra strap.

SUMMARY OF THE INVENTION

The invention described and claimed herein comprises a combination shoulder pad and brassiere strap pad which includes two portions. The brassiere strap is disposed on one portion, and the other portion is folded over and secured to the one portion. The two portions, on their inside faces, or on the surfaces which face each other, include fastening elements. The fastening elements hold the bra strap in place. The shoulder pad apparatus is relatively large in that it extends over a substantial length of the bra strap alone or over the shoulder of the user to provide a comfortable and elongated pad for the bra strap. At the same time, the apparatus comprises shoulder pads to be worn beneath a blouse or dress.

Among the object of the present invention are the following:

To provide new and useful shoulder pad apparatus;

To provide new and useful brassiere strap cushion apparatus;

To provide new and useful combination shoulder pad and brassiere strap cushion;

To provide new and useful shoulder pad and bra strap cushion having two portions which fold over to define a single apparatus; and To provide new and useful shoulder pad and bra cushion apparatus in which the shoulder pad portion extends over and beyond the bra strap cushion portion to provide smooth lines for the user's blouse or dress;

DESCRIPTION OF THE PREFERRED EMBODIMENT

Figure 1:
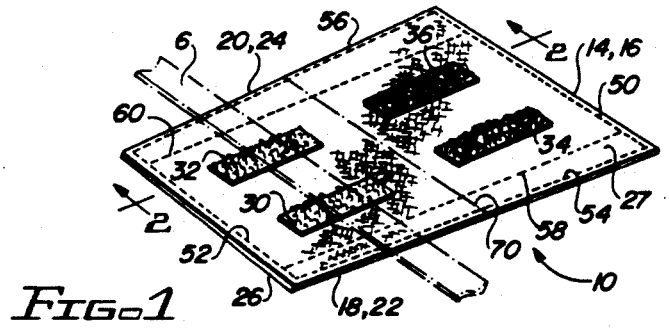
FIG. 1 is a perspective view of the apparatus of the present invention preparatory to its being used.
Figure 3:
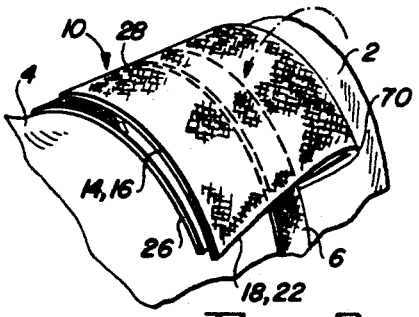
FIG. 3 is a perspective view of the apparatus invention in its use environment.
Figure 2:
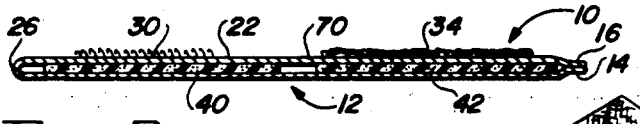
FIG. 2 is a view in partial section taken generally along line 2—2 of FIG. 1.

FIG. 1 is a perspective view of shoulder pad and bra strap apparatus 10 embodying the present invention. FIG. 2 is a view in partial section of the apparatus 10 of FIG. 1 taken generally along line 2—2 of FIG. 1 FIG. 3 is a perspective view of the apparatus 10 disposed on a users left shoulder 2. A portion of the users neck 4 is shown in FIG. 3, and the apparatus 10 is in its use configuration and environment in FIG. 3. The apparatus 10 is shown in its beginning form in FIG. 4, which comprises a perspective view of the apparatus 10 prior to its assembly to the finished form of the apparatus 10 shown in FIG. 1.

Sequentially, the fabrication of the apparatus 10 will be discussed beginning with FIG. 4, then the use of the fabricated configuration of the apparatus 10 as shown in FIGS. 1 and 2 will be discussed. Finally, the use environment of the apparatus 10 as illustrated in FIG. 3 will be discussed. However, reference may be made to any or all of the FIGS. 1-4 for the following discussion.

The apparatus 10 is made of a relative soft piece of fabric 12 which has somewhat of an hour glass configuration. There is included a pair of relatively wide outer ends 14 and 16, which are generally parallel to each other. Extending between the ends 14 and 16 are four tapering sides. The tapering sides include inwardly tapering sides 18 and 20 which extend from the outer end 14, and inwardly tapering sides 22 and 24 which extend inwardly from the outer end 16. The sides 18, 22, 20 and 24 extend inwardly to meet at a center line 26. The center line 26 is actually a fold line.

A pair of pads 40 and 42 is disposed on the portion of the fabric 12 bounded by the sides 14, 18, and 20. The pads 40 and 42 are spaced apart from each other. The pads 40 and 42 are generally of a rectangular configuration and are of the same thickness. The pad 40 is disposed adjacent to the fold line 26, and the pad 42 is disposed adjacent to the outer end 14.

Figure 4:
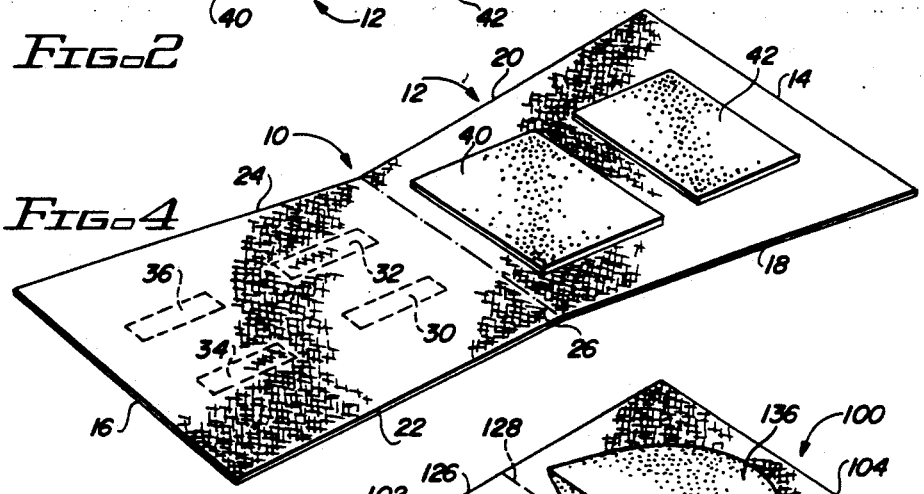
FIG. 4 is a perspective view of the apparatus of the present invention in its unfinished form.

With the pads 40 and 42 disposed on the fabric 12 as illustrated in FIG. 4, the fabric 12 is folded on the line 26 so that the edge 16 is disposed adjacent to, and overlying, the edge 14. The edges 22, 18 are accordingly aligned with each other and the edges 20, 24 are similarly aligned with each other.

As shown in FIG. 1, there are four appropriate outer stitch lines, including a relative long outer stitch line 50 adjacent to the edges 14, 16, and an inner stitch line 52 adjacent to the fold line 26. There is an outer side stitch line 54 adjacent to the edges 18, 22, and stitch line 56 adjacent to the outer edges 20, 24.

There is also a pair of inner stitch lines 58 and 60 which extend through the fabric 12 to secure the bottom pad 40 and the upper pad 42 between the folded layers of the fabric 12. The stitch line 58 is shown in FIG. 1 spaced inwardly from the stitch line 54, and the stitch line 60 as shown in FIG. 1 spaced inwardly from the stitch line 56.

There is a center fold area 70 between the end which comprises the edges 14, 16 and the end which comprises the fold line 26 of the fabric 12. The center fold area 70 is shown in both FIGS. 1 and 2.

For securing the pad apparatus 10 in place in its use environment, there are four hook and loop type fastener strips 30, 32, 34, and 36 appropriately secured to the folded fabric 12. The strips 30 and 32 are hook strips, and the strips 34 and 36 are loop strips. The strips 30 and 34 are aligned with each other, and the strips 32 and 36 are aligned with each other. The facing ends of the strips 30, 34 and 32, 36 are equally spaced apart from the center fold line of area 70.

In FIG. 1, a bra strap 6 is shown in phantom disposed over the hook straps 30 and 32. When the apparatus 10 is folded onthe center fold 70, the loop strips 34 and 36 will appropriately lock onto or be secured to the hook strips 30 and 32 on opposite sides of the bra strap 6. The apparatus 10 accordingly will be secured to itself with the strap 6 held in place. This is illustrated in FIG. 3.

The shoulder pad and bra strap apparatus 10 is designed to primarily for the situation where the primary consideration is not a shoulder pad assembly, but rather is to provide a cushion for the bra strap 6. Thus, the apparatus 10 may be best employed where a blouse or dress has built in shoulder pads or where no shoulder pads, or only minimal shoulder pads, are desired. The "upper" pad 42 is the outer pad, and the pad 40 is the cushion pad on which is disposed the strap 6. The pads 40 and 42 are of the same thickness and size, and accordingly provide a minimal shoulder pad profile but a maximum bra strap cushion function for comfort.

From FIGS. 1 and 3, it will be noted that the relatively wide end of the pad apparatus 10, which includes the edges 14, 16, comprises the top portion of the folded apparatus 10 in its use environment. The relatively wide end 14, 16 overlies the relatively narrower fold line or end 26 so that the contour of the user's blouse or dress is smooth as it overlies the pad apparatus 10.

In the apparatus 10 of FIG. 1, 2, 3, and 4, the pad 40 may be considered as a primary cushion for the bra strap, and the pad 42 is a secondary pad or cushion which acts as a relatively small shoulder pad, or smoothing pad to smooth the blouse or dress shoulder of the user.

On the other hand, a contoured shoulder pad cushion may also be desirable. A contoured secondary cushion is illustrated in FIG. 5, in the embodiment of shoulder pad and bra strap apparatus 100.

Figure 5:
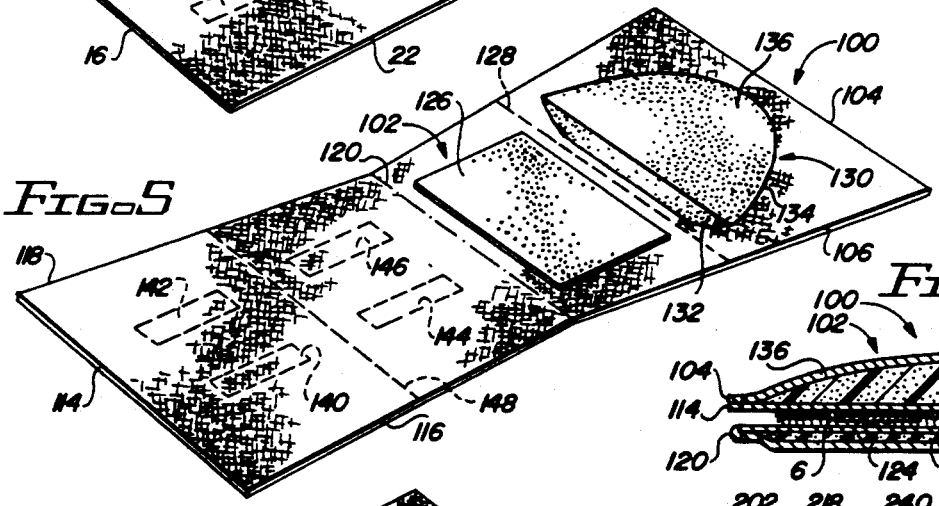
FIG. 5 is a perspective view of an alternate embodiment of the apparatus of FIG. 4.
Figure 6:
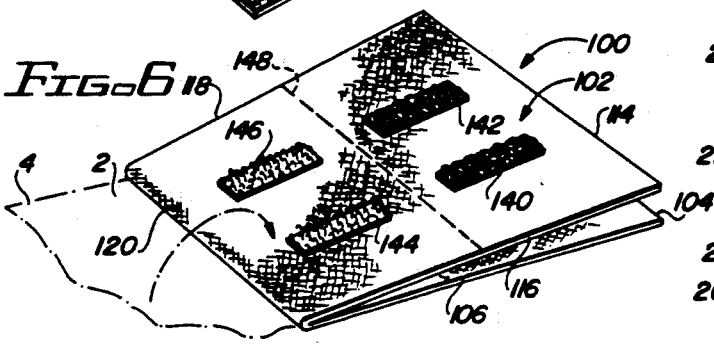
FIG. 6 is a persective view sequentially illustrating the assembly of the apparatus of FIG. 5.

On the embodiment of shoulder pad and bra strap apparatus 100, FIG. 5 is a perspective view of the apparatus prior to assembly. FIG. 6 is a perspective view illustrating the assembly of the apparatus 100 of FIG. 5.

Figure 7:
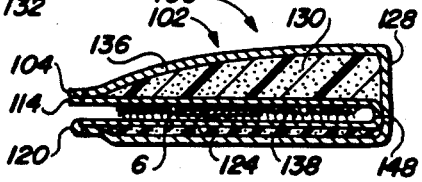
FIG. 7 is a view in partial section illustrating the apparatus of FIGS. 5 and 6 in its use environment.

FIG. 7 is a view in partial section of the shoulder pad apparatus 100 in its use environment, with the bra strap 6 secured to the apparatus 10. For the following discussion, reference will be made to FIGS. 5, 6, and 7.

In FIG. 6, a soft fabric layer 102, in the same general hour glass configuration as the fabric layer 12 of the embodiment of FIGS. 1–4, as shown. The fabric layer 102 includes a relatively wide end or edge 104, with a pair of inwardly tapering side edges 106 and 108 extending towards a center area 120. At the opposite end of the fabric 102 is another relatively wide end 114, and a pair of inwardly tapering side edges 116 and 118 extend from the edge or end 114 toward the center fold area 120.

A pair of pads or cushions 126 and 130 are disposed on one portion of the fabric 102. The pad 126 is a bra cushion pad, substantially identical to the cushion pad 40 of the apparatus 10. The pad or cushion 126 is of a generally rectangular configuration, with its long dimension generally parallel to the fold line 120. The pad or cushion 126 is disposed adjacent to the fold line 120, but spaced apart slightly therefrom.

The pad 130 is spaced apart from the pad or cushion 126. The pad 130 is a shoulder pad, and it is of a contoured or tapered configuration. The pad 130 is the upper pad, and will be disposed on the top of the folded pad apparatus, as shown in FIG. 7, in the use environment.

The pad 130 includes a generally flat inner surface 132 which faces the pad or cushion 126. The pad 130 also includes an outer curved periphery 134 which extends in a generally wide and long "U" configuration from the front surface 132, or from the opposite ends of the front surface 132. The top and bottom surface of the pad 130 are also curved. The pad 130 has a curved exterior configuration, with the center portion relatively thick and the outer portions relatively thin. Moreover, the pad 130 includes appropriate "top" and "bottom" configurations to fit both the user's shoulder and the dress or blouse under which the apparatus is disposed. The "bottom" surface of the pad 1 30 comprises a concave surface 136, and the "top" surface comprises a convex surface 138. The terms "top" and "bottom" refer to the use configuration of the apparatus 100, as shown in FIG. 7.

The top and bottom surfaces 136 and 138 are, as shown and as discussed above, of compound curvature configurations to provide both the fashionable function and the anatomical fit function for the user. This is best illustrated in FIG. 7, although it is also shown in FIG. 5.

As shown in FIG. 6, the opposite portion of the fabric layer 102 from that portion which includes the pads 126 and 130, includes four hook and loop type fastening strips. The fastening strips are on the bottom of the fabric layer 102, as viewed in FIG. 5. The fabric strips are shown in dotted line in FIG. 5, and are shown in FIG. 6. FIG. 6 illustrates the folding of the layer 102 for the completion of the fabrication of the apparatus 100. The strips include a pair of loop strips 140 and 142, and a pair of hook strips 144 and 146. The hook and loop strips are 140 . . . 146 are substantially identical to the hook and loop strips 30 . . . 36, discussed above.

The strips 140 and 142 are paired, and the strips 144 and 146 are paired. That is, the strips 140 and 144 are aligned with each other and the strips 142 and 146 are aligned with each other. Between the paired strips 140, 142, and 144 and 146 is a fold area 148. When the fabric layer 102 is folded, appropriate stitching takes place, as discussed above in junction with the apparatus 10 of FIGS. 1–4. That is, there are outer peripheral stitching at the edges 106, 116, 104, 114, and 108, 118, to secure the layer 102 in its folded condition. In addition, stitch lines extend through the fabric layer 102 to secure the pad elements 126 and 130 in place, as discussed above in conjunction with the apparatus 10 of FIGS. 1–4.

In the finished configuration, the wide ends 104, 114 are aligned and secured together. The ends 104, 114 comprises the outer end portion or top portion of the apparatus 100. The fold line 120 comprises the inner end portion, of the finished apparatus 100.

Generally aligned with the inner fold area 148, there is an upper fold area or outer fold area 128 between the pads 126 and 130. Due to the increased thickness of the pad 130, the fold area 128 is slightly larger than the fold area 148. This may be best understood from reference to FIG. 7.

In the use environment, the bra strap 6 is disposed on a hook strips 144 and 146, and the apparatus 100 is folded along the fold areas 148, 128. The loop fasteners 140, 142 are appropriately secured to the hook fasteners 144, 146. The bra strap 6, as shown in FIG. 7, is then secured to the apparatus 100, and in turn the apparatus 100 is secured to the shoulder of the user. That is, the apparatus 100 is disposed on the users shoulder 2, with the bottom inner end 120 facing toward the neck 4 and the outer ends 104, 114, which comprise the top ends, are similarly facing towards the neck 4 of the user. The contour of the upper or shoulder pad, pad 130, provides a smooth contour and shoulder pad appearance for the user, and the tapering outer edges of the pad 130 allow for a smooth transition from the shoulder pad area to the front and back of the users blouse, dress, etc. Again, the upper portion or edge 104, 114 is wider than the lower inner edge 120, as shown in FIG. 3, to provide for a smooth transition. As discussed above in conjunction with apparatus 10.

Figure 8:
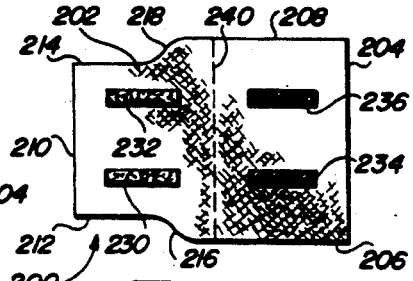
FIG. 8 is a top plan view of another alternate embodiment of the apparatus of the present invention.

FIG. 8 is a top plan view of shoulder pad and bra strap apparatus 200, which comprises another alternate embodiment of the apparatus of the present invention. The apparatus 200 differs from the apparatus 10 in that the apparatus 100 primarily in the configuration of the apparatus, as apposed to differences in the cushion themselves. Primary differences between the apparatus 10 and the apparatus 100 is in the configuration of the two pads. However, in both the apparatus 10 and the apparatus 100, the top or shoulder pad portion, which comprises the upper or outer portion of the apparatus in its folded, use environment, as shown in FIGS. 3 and 7, the top or outer portion is wider than the bottom portion. FIG. 8 illustrates another configuration, but the configuration still provides for a wider top or upper portion than the bottom portion.

In FIGS. 4 and 5, the apparatus 10 and the apparatus 100 respectively, comprise a general hourglass configuration in their unfinished, fabricated configuration. When the apparatus 10 and the apparatus 100 are finished, as shown in FIGS. 1 and 6, the general configuration of each apparatus is that of a trapezoid. The narrow end of the trapezoid comprises the bottom portion of the apparatus, and the wide end of the trapezoid comprises the top layer or portion of the apparatus in the use environment. The apparatus 200 of FIG. 8, while maintaining the wider top portion, does not comprise a hourglass configuration. Rather, a different configuration is provided in which the top outer edges are generally parallel to each other rather than tapering inwardly.

The bra strap and shoulder pad cushion apparatus 200 includes a soft fabric double layer 202, with an upper inner end 204, which relatively wide, and an lower inner end 210 which is relatively narrow. The ends 204 and 210 are generally parallel to each other. Extending from the upper wide end 204 is a pair of upper sides 206 and 208. The sides 206 and 208 are generally parallel to each other. Extending from the lower narrow end 210 is another pair of sides, a pair of lower sides 212 and 214. The lower sides 212 and 214 are parallel to each other. For joining the sides 206 and 212 is a curved side portion 216, and joining the sides 208 and 214 is a curved side portion 218.

It will be noted that the sides 206 and 208 are relatively longer than the sides 212 and 214.

Secured to the soft fabric on the inner sides or inner portion, are a pair of hook strips 230 and 232 and a pair of strips 234 and 236. The hook strip 230 is aligned with the loop strip 234, and hook 232 is aligned with the hook strip 236. The strips 232 and 234 are spaced apart from each other generally parallel to each other, as are the strips 234 and 236. Between the paired strips 232, 230, and 236, 234 is a center fold area 240. In the use configuration, as illustrated in FIGS. 3 and 7, the apparatus 200 is folded along the center fold area 240, after a bra strap is disposed on the hook strips 230 and 234. The loop strips 234 and 236 are then secured to their paired hook strips 230 and 232 respectively, to hold the bra strap in place and to in turn secure the apparatus 200 to the shoulder of the user.

As is evident from FIG. 8, the wide end 204, the upper end, will overlie the bottom, narrow end 210, and will extend outwardly beyond the lower, area 210, similarly to the apparatus 10 and 100 discussed above. However, the side contours will be different since the sides 206 and 208 are generally parallel to each other, instead of tapering, as in the embodiments of apparatus 10 and 100.

It will be noted that the sides 212 and 214 are substantially shorter than the sides 206 and 208, and it will be further noted that the curved portions 216 and 218 are on the bottom portion of the apparatus 200. That is, the fold area 240 is along the relative long side edges 206 and 208. This gives a distinctly different use configuration to the apparatus 200 as compared to the apparatus 10 and the apparatus 100. Thus, on the users shoulder, the upper edges 206 and 208 will be generally parallel to the shoulder, line, while the upper edges of the apparatus 10 and the apparatus 100 will be tapering outwardly or downwardly from the fold area and toward the neck portion of the user.

It will be obvious that there are other possible configurations that will similarly provide a relatively wider top inner end for a bra and shoulder pad apparatus than illustrated in FIGS. 1, 6, and 8. However, for convenience, only two of the different configurations are illustrated herein.

It will also be obvious that, with the different configurations different types of pads may also be used, including the rectangular pads illustrated in FIG. 4, and the pads may be of different thickness. Moreover, as shown in FIG. 5 and in FIG. 7, the upper, shoulder, pad may also be of different configurations and it need not be rectangular, although rectangular may be deferred configuration for the shoulder strap pad or cushion.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, within the limits only of the true spirit and scope of the invention.

What I claim is:

1. Shoulder pad and brassier strap pad apparatus, comprising, in combination:

outer element means having first and second outer ends, which outer ends have a first width, and a center portion having a second width which is less than the first width, and which center portion comprises a first fold area, the first fold area dividing the outer element means into a first and second portion, which first and second portions extend respectively from the first and second outer ends inwardly to the center portion;

pad means disposed on the first portion between the center portion and the first outer end, the pad means including a first pad defining a brassiere strap pad and a second pad spaced apart from the first pad and defining a shoulder pad;

means for securing the second portion over the pad means to the first portion;

fastening means on the second portion, including a first fastener portion adjacent to the first fold area and disposed above the first pad and a second fastener portion adjacent to the outer ends and disposed over the second pad, a second fold area defined between the first and second pads and the first and second fastener portions; and the first fastener portion is adapted to receive a brassiere strap, and the second fastener portion is adapted to be disposed against the first fastener portion upon the folding of the apparatus on the second fold area to hold the brassiere strap in place, with the outer ends disposed in an overlying relationship on the first fold area and extending outwardly therefrom.

2. The apparatus of claim 1 in which the first and second pads are substantially identical.

3. The apparatus of claim 1 in which the first pad of the pad means is generally rectangular in configuration and has a first thickness.

4. The apparatus of claim 3 in which the second pad of the pad means is substantially identical to the first pad.

5. The apparatus of claim 3 in which the second pad of the pad means includes a generally flat surface adjacent to the second fold area and an outer curved periphery extending from the generally flat surface.

6. The apparatus of claim 3 in which the second pad of the pad means has a second thickness which is greater than the first thickness.

7. The apparatus of claim 6 in which the second pad of the pad means includes a convex portion and a concave portion.

8. The apparatus of claim 1 in which the outer element means includes first and second sides tapering inwardly from the first outer end to the first fold area, and third and fourth sides tapering inwardly from the second outer end to the first fold area and defining a generally trapezoidal configuration where the second portion is disposed over the pad means and secured to the first portion.

9. The apparatus of claim 1 in which the outer element means has a third width at the second fold area and the third width which is less than the first width.

10. The apparatus of claim 1 in which the outer element means has a third width at the second fold area, and the third width is substantially the same as the first width.

11. Shoulder pad and brassiere strap pad apparatus, comprising, in combination:

a bottom brassiere strap pad;

a bottom portion disposed about the bottom brassiere strap pad and having a first end facing a user's neck, the first end having a first width;

a top shoulder pad;

a top portion disposed about the top shoulder pad and having a second end, the second end having a second width that is greater than the first width;

a fold area between the bottom portion and the top portion, with the bottom portion receiving a brassiere strap over the bottom pad, and the top portion folded at the fold area and disposed on the bottom portion and on the brassiere strap; and means for securing the top portion to the bottom portion.

12. The apparatus of claim 11 in which the fold area has a third width, and the third width is greater than the first width.

13. The apparatus of claim 11 in which the fold area has a third width, and the third width is substantially the same as the second width.

14. The apparatus of claim 11 in which the fastening means includes a first fastener portion on the bottom portion and the brassiere strap is disposed on the first fastener portion, and a second fastener portion on the top portion, and the first and second fastener portions cooperate to secure the top and bottom portions together.

15. The apparatus of claim 11 in which the bottom brassiere strap pad has a first thickness and the top shoulder pad has a second thickness, and the first thickness is the same as the second thickness.

16. The apparatus of claim 11 in which the bottom brassiere strap pad has a first thickness and the top shoulder pad has a second thickness which is greater than the first thickness.

17. The apparatus of claim 11 which the bottom brassiere strap pad has a generally rectangular configuration.

18. The apparatus of claim 17 in which the top shoulder pad has a generally rectangular configuration.

19. The apparatus of claim 11 in which the shoulder pad includes a concave portion and a convex portion.

* * * * *